US012188143B2

(12) United States Patent
Zhang et al.

(10) Patent No.: US 12,188,143 B2
(45) Date of Patent: Jan. 7, 2025

(54) ELECTROPLATING DEVICE AND ELECTROPLATING SYSTEM

(71) Applicants: Tyco Electronics (Shanghai) Co., Ltd., Shanghai (CN); Tyco Electronics (Suzhou) Ltd., Suzhou (CN)

(72) Inventors: Daiqiong (Diana) Zhang, Shanghai (CN); Yuelin (Kevin) Liang, Shanghai (CN); Dongqing (Gates) Peng, Suzhou (CN); Chunyan (Cherie) Zhou, Shanghai (CN); Zhongxi Huang, Shanghai (CN)

(73) Assignees: Tyco Electronics (Suzhou) Ltd., Suzhou (CN); Tyco Electronics (Shanghai) Co., Shanghai (CN)

( * ) Notice: Subject to any disclaimer, the term of this patent is extended or adjusted under 35 U.S.C. 154(b) by 175 days.

(21) Appl. No.: 17/588,242

(22) Filed: Jan. 29, 2022

(65) Prior Publication Data

US 2022/0243355 A1 Aug. 4, 2022

(30) Foreign Application Priority Data

Jan. 29, 2021 (CN) ..... 202110133322.3

(51) Int. Cl.
*C25D 17/02* (2006.01)
*C25D 21/14* (2006.01)

(52) U.S. Cl.
CPC ..... *C25D 21/14* (2013.01); *C25D 17/02* (2013.01)

(58) Field of Classification Search
None
See application file for complete search history.

(56) References Cited

U.S. PATENT DOCUMENTS 5,976,341 A 11/1999 Schumacher et al.
2004/0232005 A1* 11/2004 Hubel ..... C25D 17/12 204/230.2
2010/0176004 A1* 7/2010 Schneider ..... C25D 17/001 204/224 R (Continued)

FOREIGN PATENT DOCUMENTS

CN 203034115 * 7/2013 ..... C25D 5/08
CN 104862767 A 8/2015

(Continued)

OTHER PUBLICATIONS

English translation CN 104862767, Jiang et al. (Year: 2015).*

(Continued)

*Primary Examiner* — Stefanie S Wittenberg
(74) *Attorney, Agent, or Firm* — Barley Snyder

(57) ABSTRACT

An electroplating device includes an electroplating bath containing an electroplating solution into which a workpiece to be electroplated as a cathode is at least partially immersed, a first anode provided in the electroplating bath, and a liquid spraying device. The liquid spraying device includes a main body part having at least one inlet for conveying the electroplating solution into the main body part, and a plurality of nozzles installed on the main body part. At least part of the nozzles are positioned such that a flow direction of the electroplating solution ejected from the nozzle is substantially parallel to a direction of a power line formed by the first anode and the cathode.

20 Claims, 10 Drawing Sheets

(56) References Cited

U.S. PATENT DOCUMENTS

| | | | | |
|---|---|---|---|---|
| 2012/0043301 | A1* | 2/2012 | Arvin | G01N 27/404 118/712 |
| 2013/0081939 | A1* | 4/2013 | Noda | C25D 17/10 204/198 |
| 2014/0120245 | A1* | 5/2014 | Isono | C25D 5/026 205/125 |

FOREIGN PATENT DOCUMENTS

| | | | | |
|---|---|---|---|---|
| CN | 206109565 U | | 4/2017 | |
| JP | H08253892 | * | 10/1996 | C25D 5/02 |
| JP | 2001316887 | * | 11/2001 | C25D 17/00 |
| JP | 2006257492 A | | 9/2006 | |

OTHER PUBLICATIONS

Hubel et al., English translation DE 10349392 (Year: 2004).*
English translation CN 207738872, Tian (Year: 2018).*
GB2101159 (Year: 1983).*
Chinese First Office Action dated May 31, 2023 with English translation, corresponding to Application No. 202110133322.3, 19 pages.

* cited by examiner

ELECTROPLATING DEVICE AND ELECTROPLATING SYSTEM

CROSS-REFERENCE TO RELATED APPLICATIONS

This application claims the benefit of Chinese Patent Application No. CN202110133322.3 filed on Jan. 29, 2021, the whole disclosure of which is incorporated herein by reference.

FIELD OF THE INVENTION

The present disclosure relates to an electroplating device and an electroplating system comprising the electroplating device.

BACKGROUND

According to the prior art, electroplating copper, nickel, tin, gold, silver and related alloy on a workpiece such as a connecting terminal, mainly includes barrel plating and hanging plating techniques according to the type of the electroplating equipment used. In the process of hanging plating, the electroplated workpieces are arranged on a strip or hung on a special material strip to facilitate continuous electroplating. The traditional continuous electroplating device mainly includes a mother tank and an overflow tank.

Generally, the overflow tank is suitable for containing the electroplating solution. Overflow ports are formed on the opposite sides of the overflow tank, and the material strip of the electroplated workpiece is arranged to continuously pass through the overflow ports, so that the workpiece is subject to electroplating, water washing and other processes between different overflow tanks. At the same time, electroplating solution overflowing from the overflow tank flows back to the mother tank through a pump without polluting the adjacent overflow sub-tanks. Specifically, the electroplating solution is expelled from bottom to top in the overflow tank, and continuously circulates and changes the electroplating solution to ensure consistent electroplating quality. By adjusting the flow of the pump and the width of the overflow port, the liquid level of the electroplating solution in the overflow tank can be controlled, so as to complete simple selective electroplating.

In the prior art, the two sides of the overflow tank are provided with anodes. The anodes are parallel to the two sides of the material strip used as the cathode, and an electric field is formed between the anode and the cathode to realize electroplating. Because the electroplating liquid flow direction near the cathode is single and the liquid flow impact force is weak, there is almost no electroplating liquid flow impact on the anode surface, which greatly limits the electroplating effect on the functional area of a workpiece with complex structures (such as sides, holes, depressions, cup mouths and cavities), and the electroplating efficiency is low. In addition, as the flow direction of the electroplating solution is mainly from bottom to top and perpendicular to the electric field power line, that is, parallel to the electroplated functional surface of the cathode material strip, the electroplating solution has insufficient impact on the electroplated functional surface. As a result, it is easy to cause fog in the plane electroplating area, burning at the tip, uneven distribution of coating thickness, especially in the fine needle, sharp convex, hole, depression, cup mouth and cavity structures on complex parts. In addition, the exchange rate of electroplating solution is less than required, or the amount of electroplating solution on the back surface of the material strip opposite to the high-speed running direction of the material strip is thin, and missing plating or false plating (weak coating adhesion) occurs in serious cases.

Improved systems and methods are therefore desired.

SUMMARY

An electroplating device according to an embodiment of the present disclosure comprises an electroplating bath containing an electroplating solution into which a workpiece to be electroplated as a cathode is at least partially immersed, a first anode provided in the electroplating bath, and a liquid spraying device. The liquid spraying device includes a main body part having at least one inlet for conveying the electroplating solution into the main body part, and a plurality of nozzles installed on the main body part. At least part of the nozzles are arranged so that a flow direction of the electroplating solution ejected from the nozzle is substantially parallel to a direction of a power line formed by the first anode and the cathode.

BRIEF DESCRIPTION OF THE DRAWINGS

The invention will now be described by way of example with reference to the accompanying Figures, of which.

DETAILED DESCRIPTION OF THE EMBODIMENTS

Figure 1:
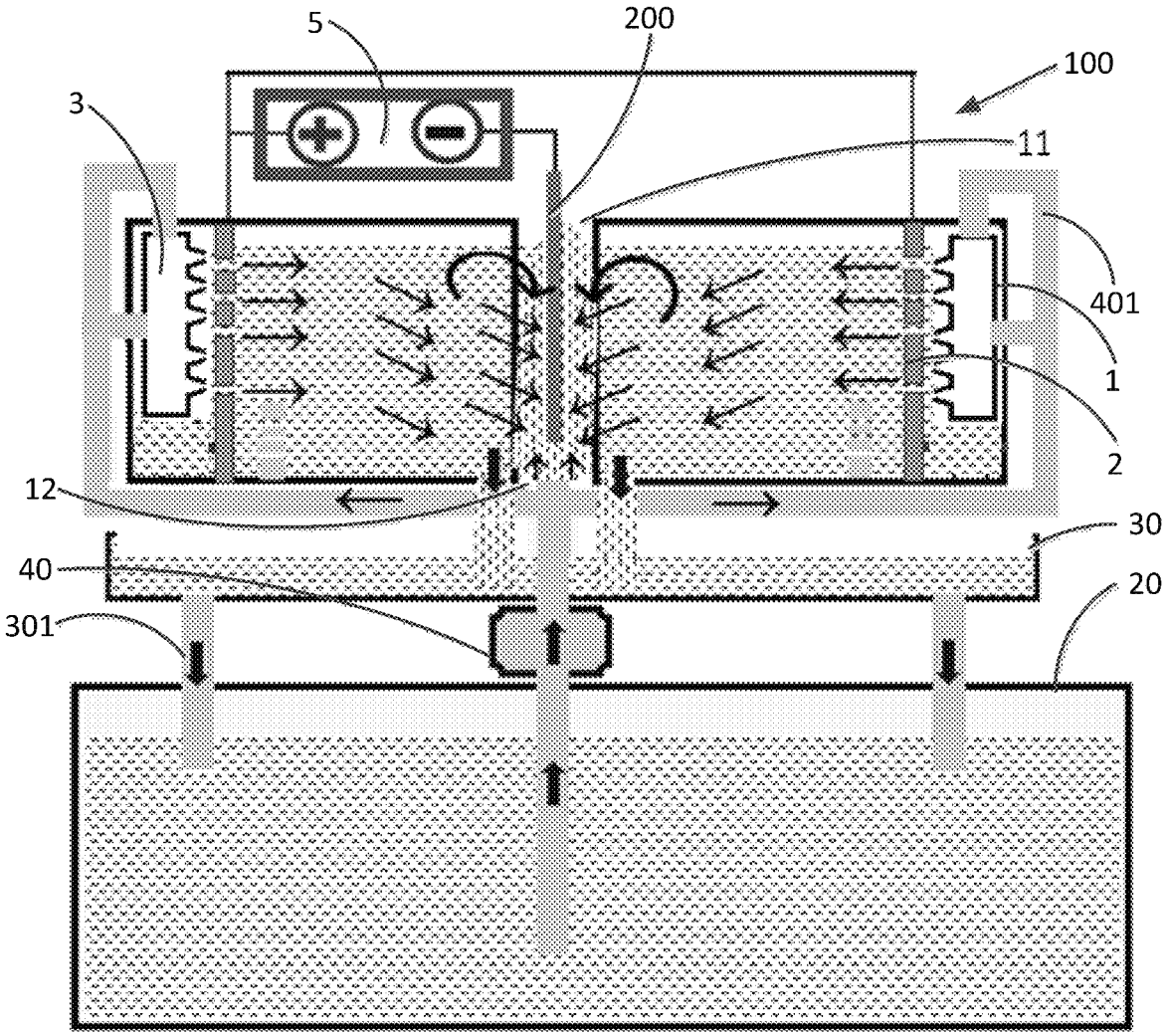
FIG. 1 shows an illustrative view of an electroplating system according to an exemplary embodiment of the present invention.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, an electroplating device comprising an electroplating bath suitable for containing an electroplating solution into which a workpiece to be electroplated as a cathode is at least partially immersed, a first anode provided in the electroplating bath, and a liquid spraying device. The liquid spraying device comprises a main body part provided with at least one inlet for conveying the electroplating solution into the main body part, and a plurality of nozzles installed on the main body part. At least a portion of the nozzles are arranged such that a flow direction of the electroplating solution ejected from the nozzle is substantially parallel to a direction of a power line formed by the first anode and the cathode.

According to another embodiment of the present disclosure, an electroplating system includes the above electroplating device, a tank into which the electroplating solution overflowing from the electroplating bath flows, and a pump adapted to pump the electroplating solution from the tank to the inlet of the liquid spraying device through a pipe.

Figure 2:
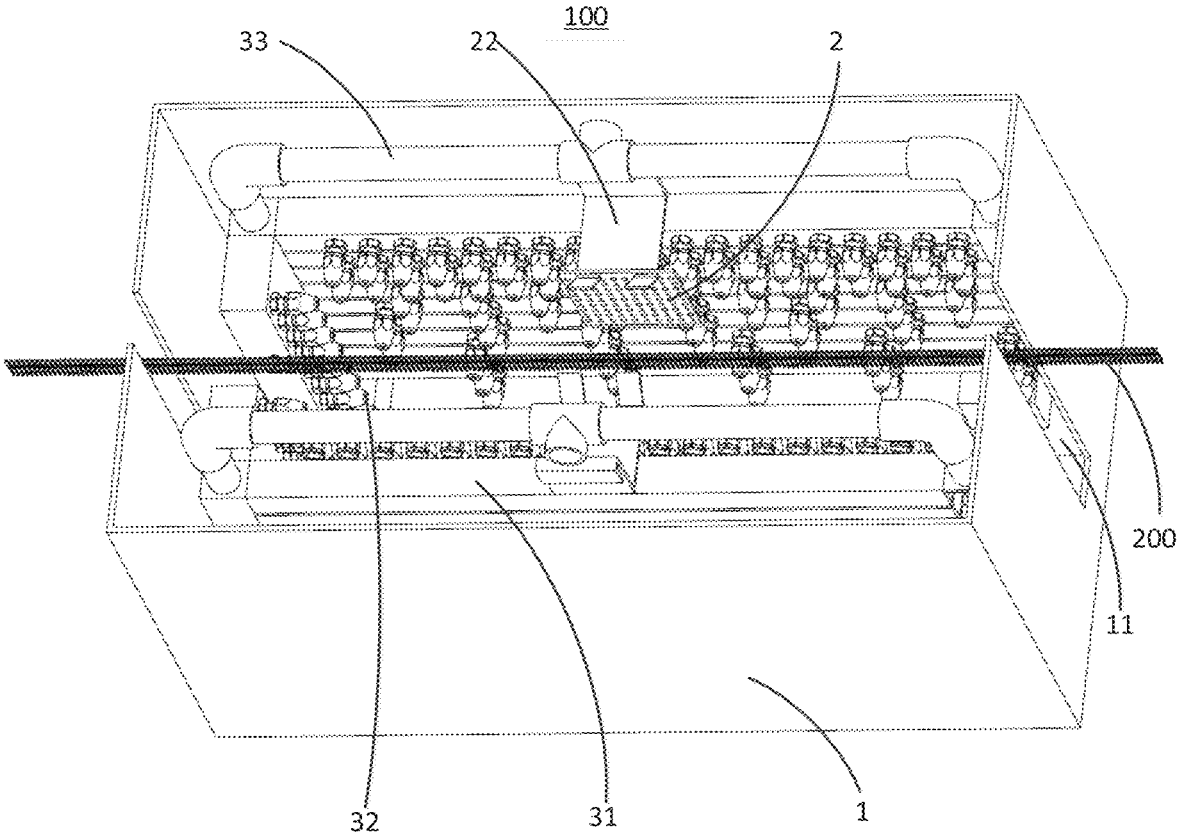
FIG. 2 shows an illustrative perspective view of an electroplating device according to an exemplary embodiment of the present invention.
Figure 3:
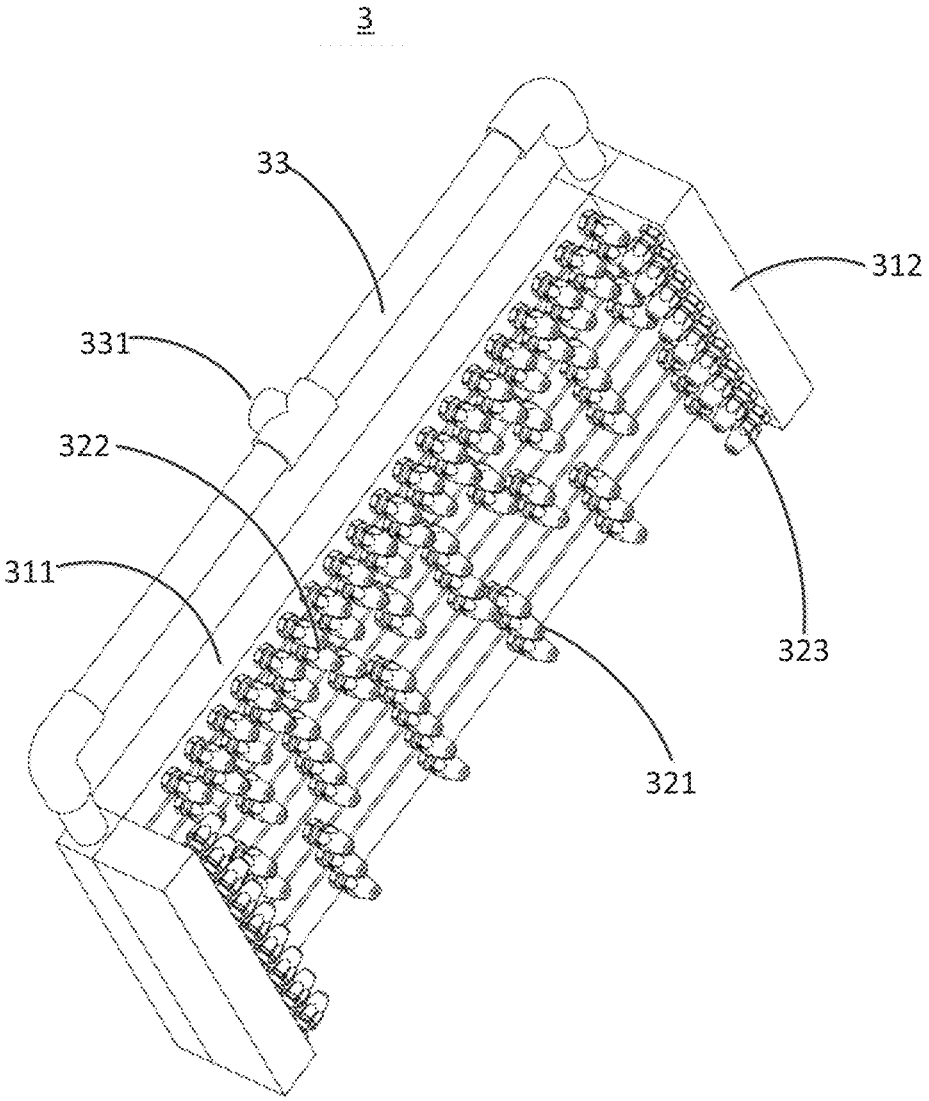
FIG. 3 shows an illustrative perspective view of a liquid spraying device according to an exemplary embodiment of the present invention.

FIG. 1 is an illustrative view of an electroplating system according to an exemplary embodiment of the present invention; FIG. 2 shows an illustrative perspective view of an electroplating device according to an exemplary embodiment of the present invention; FIG. 3 shows an illustrative perspective view of a liquid spraying device according to an exemplary embodiment of the present invention. According to an exemplary embodiment of the present invention, as shown in FIGS. 1-3, an electroplating system comprises an electroplating device 100 (described in detail below), a tank 20 and a pump 40. In the electroplating process, the electroplating solution overflowing from the electroplating bath 1 of the electroplating device 100 flows into the tank 20. The pump 40 is suitable for pumping the electroplating solution from the tank 20 to the electroplating bath 1 through the pipe 401 to supplement the electroplating solution to the electroplating bath 1.

The electroplating device 100 is suitable for electroplating a metal layer on the workpiece 200 by roll plating or hanging plating, and the electroplated workpiece 200 can be arranged or directly connected to a material strip to move with the material strip. The electroplating device 100 includes an electroplating bath 1, a first anode 2 and a liquid spraying device 3. The electroplating bath 1 is suitable for containing an electroplating solution into which the workpiece 200 to be electroplated as a cathode is at least partially immersed. The first anode 2 is provided in the electroplating bath 1. The liquid spraying device 3 comprises a main body part 31 and a plurality of nozzles 32. The main body part 31 is formed into a vacuum and is provided with at least one inlet for conveying the electroplating solution into the main body part 31. A plurality of nozzles 32 are installed on the main body 31, and at least a part of the nozzles 32 are configured so that the flow direction of the electroplating solution ejected from the nozzle 32 is substantially parallel to the direction of the power line formed by the first anode 2 and the cathode.

Generally, the liquid flow direction of the electroplating solution acting on the electroplated material strip parallel to the power line and perpendicular to the power line is a liquid flow direction with the highest electroplating efficiency. According to the above embodiment of the invention, at least part of the nozzles of the liquid spraying device can strongly spray the electroplating solution with a certain flow rate as the cathode (that is, the workpiece 200 to be electroplated), and the flow direction of the electroplating solution sprayed from the nozzle is roughly parallel to the direction of the power line formed by the first anode and cathode, which can improve the electroplating efficiency.

As shown in FIG. 2, the first anode 2 is arranged between the liquid spraying device 3 and the workpiece 200. The first anode 2 provides the metal required for electroplating, which can be made of a single metal or an alloy material to provide several metals required for alloy electroplating. For example, the first anode may be made of a material such as insoluble anode platinum/carbon. The first anode 2 is formed with a plurality of first through holes 21, and a part of the electroplating solution ejected from the nozzles 32 flows through the first through holes 21.

In an embodiment, a plurality of first anodes 2 are provided, and there is a gap between two adjacent first anodes 2. For example, the first anode is arranged as a flat plate which is reticulated and has a plurality of through holes, or the first anode is composed of multiple sections and slots to allow liquid flow penetration and play a certain buffer role. A part of the electroplating solution reaches the surface of the electroplated workpiece through the first through holes of the first anode 2 or the gap between two adjacent first anodes. The electroplating solution flow can fully impact the first anode 2, effectively activate the first anode 2, accelerate the metal dissolution rate of the first anode 2 and disperse into the electroplating solution in time, so as to further improve the working efficiency of the first anode 2 and reduce the amount of the first anode. Further, the dissolution by-products (such as anode mud) of the first anode 2 can also flow to the tank 20 in time, so that the electroplating solution can be filtered and cleaned to avoid the coarseness of the coating due to impurities.

As shown in FIGS. 2 and 3, for example, the pipe 401, the electroplating bath 1, and the nozzle 32 may be made of non-metallic insulating materials such as polypropylene (PP), polytetrafluoroethylene, and corrosion-resistant materials. The nozzle 32 is detachably mounted on the main body part 31. In this way, nozzles of different models and sizes can be replaced according to the type of workpiece 200 to be electroplated or the type of electroplating solution. The spray direction of at least part of the nozzles is configured to be adjustable. In this way, the injection angle of the liquid flow of the electroplating solution ejected by the nozzle can be changed to adapt to the change of the shape and/or structure of the workpiece 200 to be electroplated.

The nozzle 32 (e.g., a flow thereof) is adapted to be sparse in the high current density region and compact or dense in the low current density region. The plurality of nozzles are arranged in parallel in the horizontal direction, or in parallel in the vertical direction, or cross. Further, the arrangement density of the nozzles 322 on the upper part of the main body part 31 is greater than that of the nozzles 321 on the lower part of the main body part. In this way, the suitable flow speed of the electroplating solution combined with the suitable current density can improve the uniformity of the electroplating coating to be electroplated on the workpiece 200.

The main body part 31 of the liquid spraying device 3 includes a first part 311 and two second parts 312. The two second parts 312 are respectively arranged at both ends of the main body part 311 and extend towards the workpiece 200. In this way, in the top view, the main body parts 31 of the two opposite liquid spraying devices 3 form an approximate "H" shape. The nozzle 32 of each liquid spraying device 3 includes a plurality of first nozzles 321, 322 and a plurality of second nozzles 323. The first nozzles 321 and 322 are installed on the first part 311, and the flow direction of the electroplating solution ejected from the first nozzle is substantially parallel to the direction of the power line formed by the first anode 2 and the cathode. A plurality of second nozzles 323 are arranged on the inner side of the two second parts 312 and eject electroplating solution in opposite directions. That is, the second nozzles provided on the two second parts 312 sprays electroplating solution towards the workpiece 200 in the longitudinal direction. With the electroplated workpiece 200 as the center, the electroplating solution is sprayed from the first nozzle and the second nozzle at various angles in the left-right direction and the front and rear direction respectively, forming a multi angle strong jet to surround the electroplated workpiece as the cathode. The strong jet impacts the pothole dead corner of the workpiece, which can improve the finish, uniform electroplating ability and adhesion of the electroplating coating. The electroplating device according to the embodiment of the present invention is particularly suitable for electroplating of functional areas on concealed places, such as sides, holes, depressions, cup openings and complex parts in the cavity, such as terminals with crimping surface on the side and female terminals with contact surface in the cup opening or cavity structure.

In an exemplary embodiment, the workpiece 200 is provided on a material belt by direct connection or detachable installation, for example, the material belt is arranged to move horizontally through the electroplating bath 1, and the flow direction (transverse direction) of the electroplating solution ejected from the first nozzle is perpendicular to the moving direction (longitudinal direction) of the material belt. The electroplating device according to the embodiment of the invention can avoid the phenomenon of thin liquid on the back surface of the workpiece when the material belt runs at high speed, so as to improve the electroplating efficiency.

Two opposite side walls of the electroplating bath 1 are respectively provided with overflow ports 11, and the material belt moves through the overflow ports 11. The electroplating solution in the electroplating bath 1 can flow out of the overflow port 11.

Figure 4:
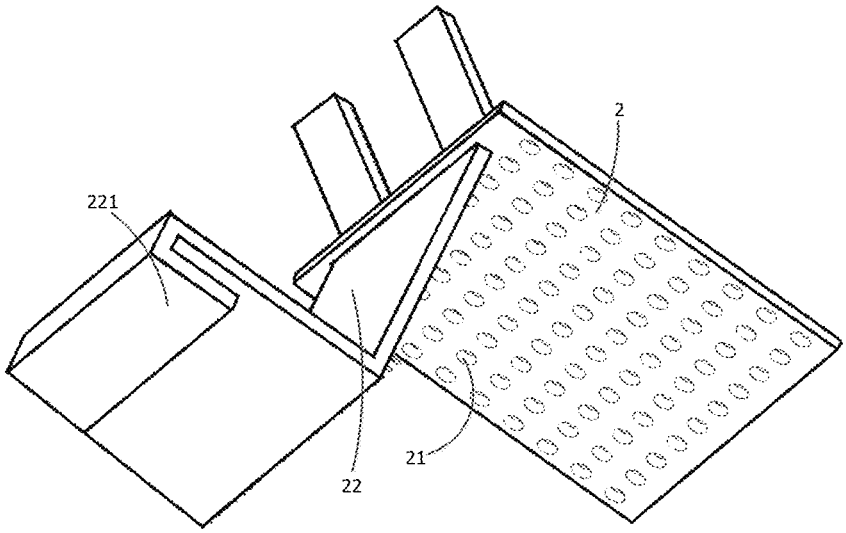
FIG. 4 shows an illustrative perspective view of a first anode according to an exemplary embodiment of the present invention.

FIG. 4 shows an illustrative perspective view of a first anode according to an exemplary embodiment of the present invention. As show in FIG. 4, in an embodiment, the first anode 2 can be mounted on the side wall of the electroplating bath 1 by a first bracket 22. For example, a hook 221 is provided on the first bracket 22 to conveniently hang the first bracket 22 detachably on the side wall of the electroplating bath 1.

As shown in FIG. 1, the electroplating device 100 also includes a power supply device 5 suitable for supplying power to the first anode 2. The power supply device 5 may be a DC power supply or a pulse power supply that may provide a pulse voltage or current.

The electroplating system includes: the electroplating device 100 according to any of the above embodiments, the tank 20 and the pump 40. The electroplating solution overflowing from the electroplating bath 1 flows into the tank 20; The pump 40 is suitable for pumping the electroplating solution from the tank 20 to the inlet 301 of the liquid spraying device 3 through the pipe 401, and the electroplating solution inside the liquid spraying device 3 is sprayed into the electroplating bath from each nozzle 32. The electroplating device 100 also includes a transition tank 30, and the electroplating solution overflowing from the electroplating bath 1 flows to the tank 20 through the transition tank 30.

The positive pole of the power supply device 5 is connected to the first anode 2, and the negative pole is connected to the workpiece 200 as the cathode. The arrow in the figure indicates the flow direction of electroplating solution. In the electroplating process, the workpiece 200 and the first anode 2 are immersed in the electroplating solution containing the ions to be electroplated at the same time, the cathode is reduced, and the ions to be electroplated are reduced to atoms on the workpiece 200, so as to be electroplated on the surface of the workpiece; The first anode has oxidation reaction, and the material of the first anode preferentially adopts the metal to be electroplated, which is oxidized into the ions to be electroplated and dissolved into the electroplating solution, so as to maintain the stability of the concentration of ions to be electroplated in the electroplating solution.

The electroplating solution in the electroplating bath 1 first flows into the transition tank 30 from the overflow port 11 of the electroplating bath, and then flows into the tank 20 through the return pipe 301 of the transition tank 30, so that the electroplating solution can be filtered and cleaned; The electroplating solution in the tank 20 is then transported to the liquid spraying device 3 through the pipe 401 by the pump 40, and sprayed into the electroplating bath from the nozzle 32, so as to circulate.

It should be noted that in the embodiment shown in FIG. 1, the pipe 401 can deliver electroplating solution to the electroplating bath 1 through the second liquid inlet holes 12 on the bottom wall of the electroplating bath 1. In addition, the electroplating solution in the electroplating bath 1 can also flow to the transition tank 30 through other openings on the bottom wall. It can be understood that the electroplating solution can flow into and out of the electroplating bath through a plurality of liquid inlet holes and openings, which can allow the electroplating solution to flow in multiple directions.

The electroplating device 100 of the embodiment of the invention is suitable for electroplating single metal coating, such as electroplating gold, rhodium, silver, palladium, nickel, copper, tin, indium, bismuth, lead, cobalt, iron, zinc, etc., on precision electronic components such as terminals, locks and shells. Its process is relatively stable and controllable, so that electronic components can obtain better mechanical, electrical, anti-corrosion and other properties.

Figure 5:
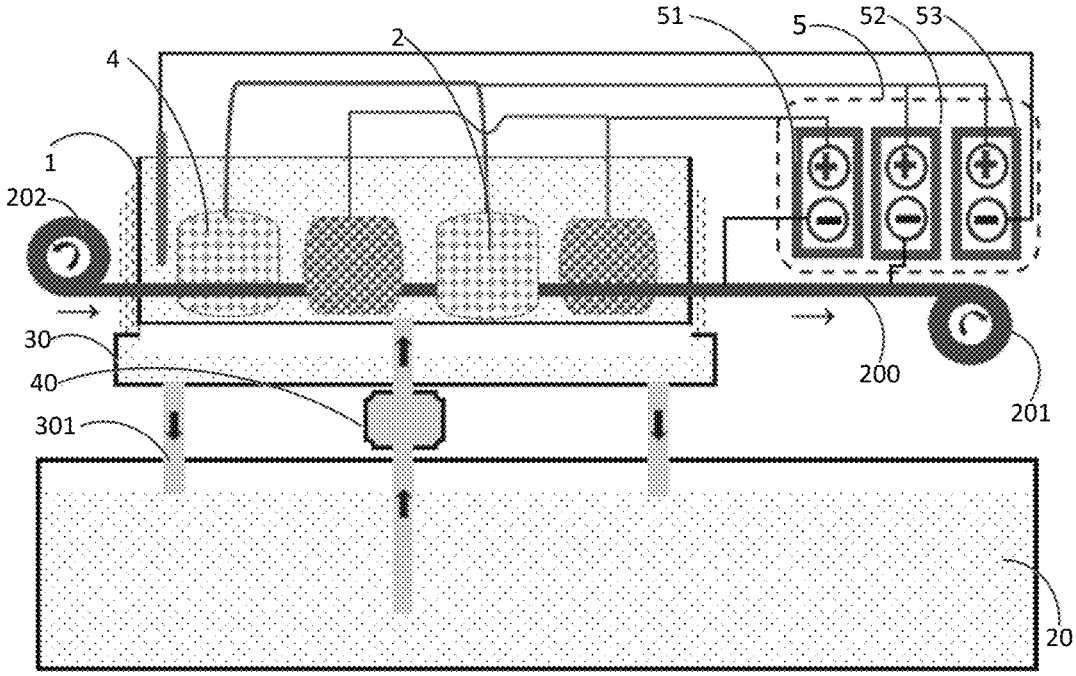
FIG. 5 shows an illustrative view of an electroplating system according to another exemplary embodiment of the present invention, in which the electroplating bath is cut way in a longitudinal direction.
Figure 6:
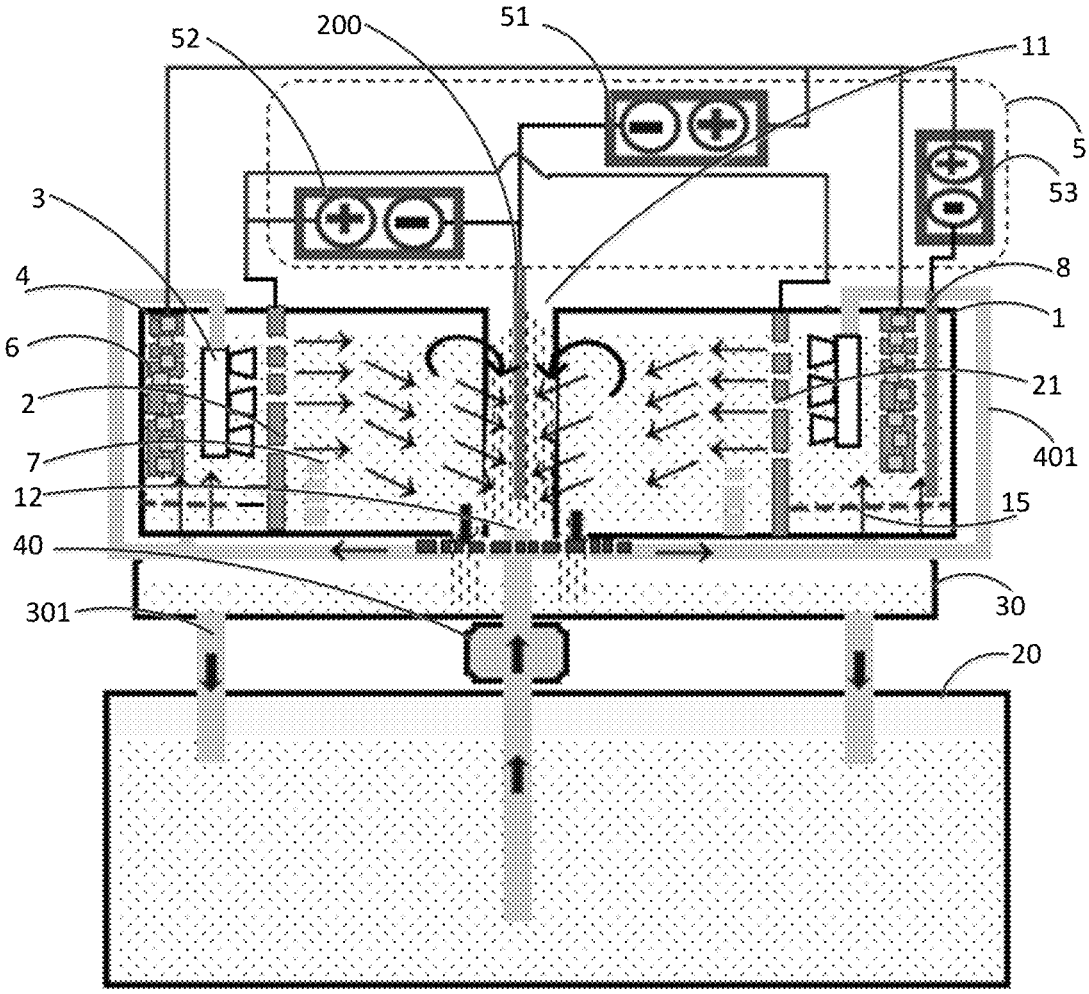
FIG. 6 shows another illustrative view of the electroplating system shown in FIG. 5, in which the electroplating bath is cut way in a transverse direction.
Figure 7:
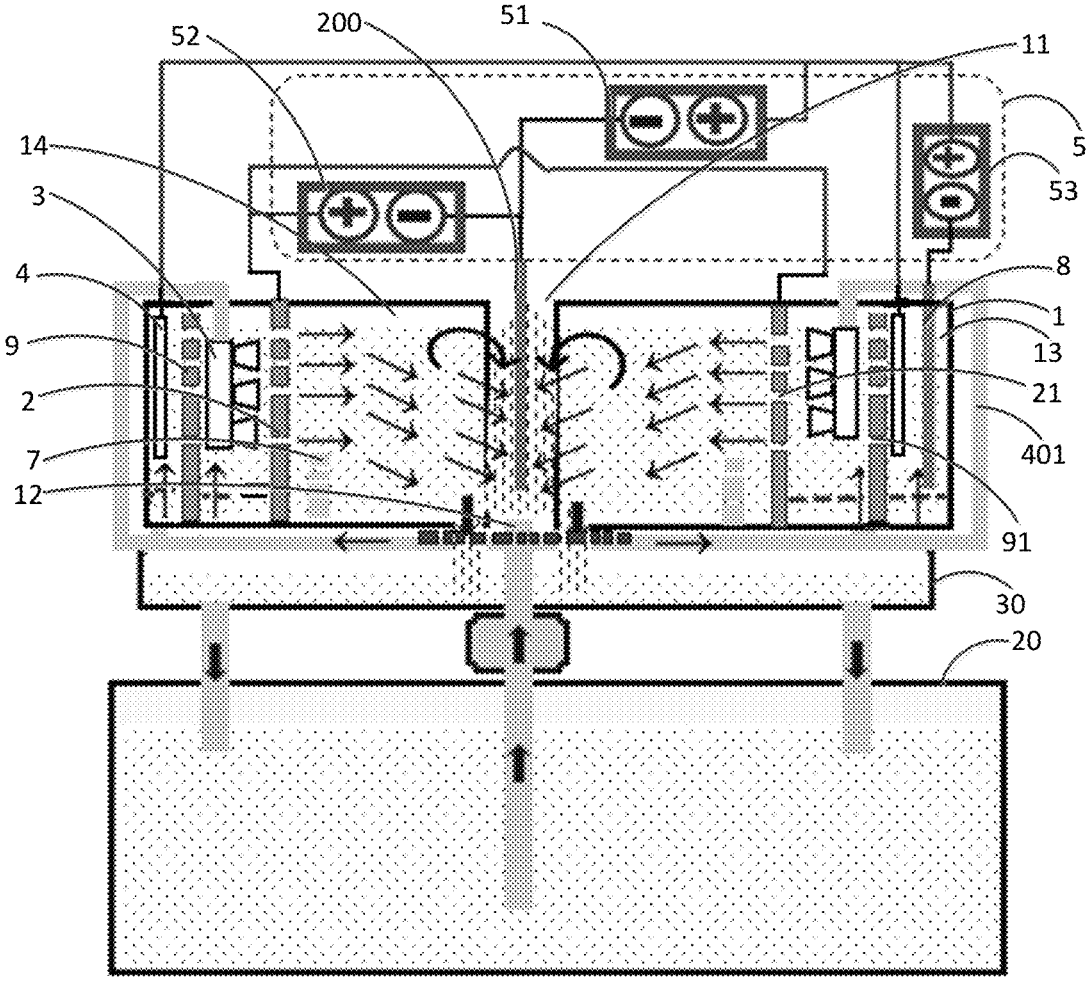
FIG. 7 shows an illustrative view of an electroplating system according to another exemplary embodiment of the present invention, in which the electroplating bath is cut way in a transverse direction.
Figure 8:
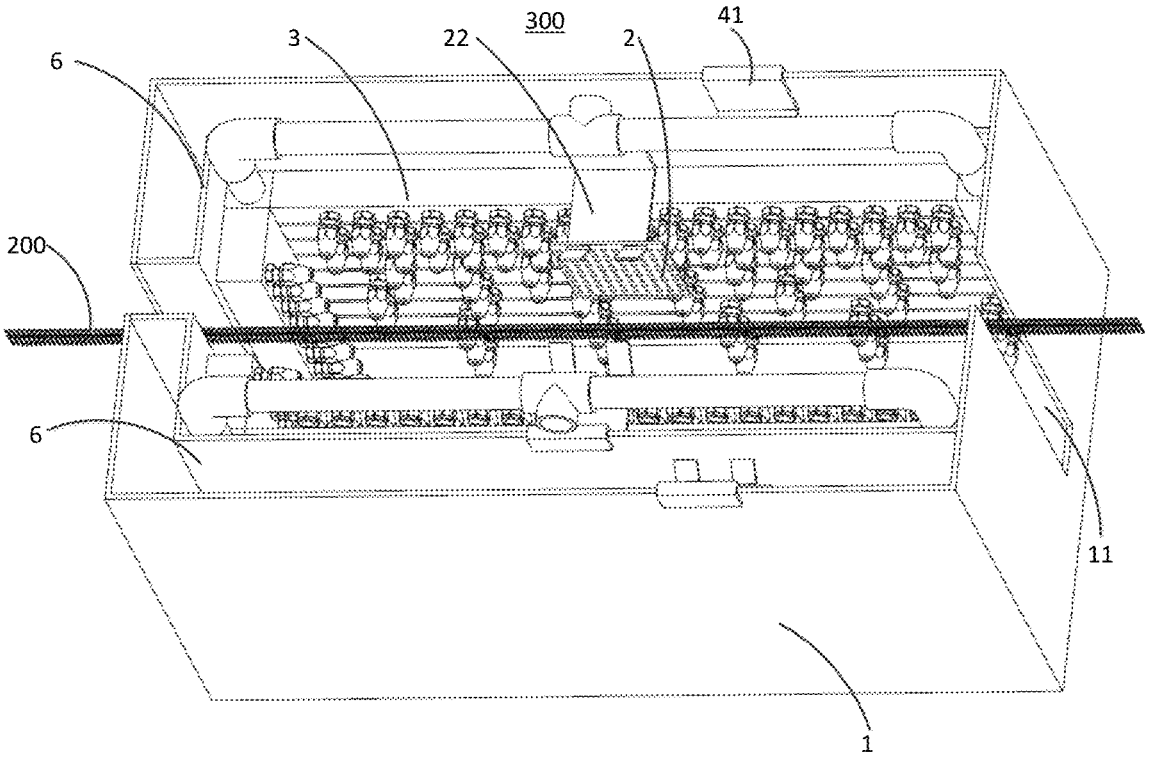
FIG. 8 shows an illustrative perspective view of an electroplating device according to another exemplary embodiment of the present invention.
Figure 9:
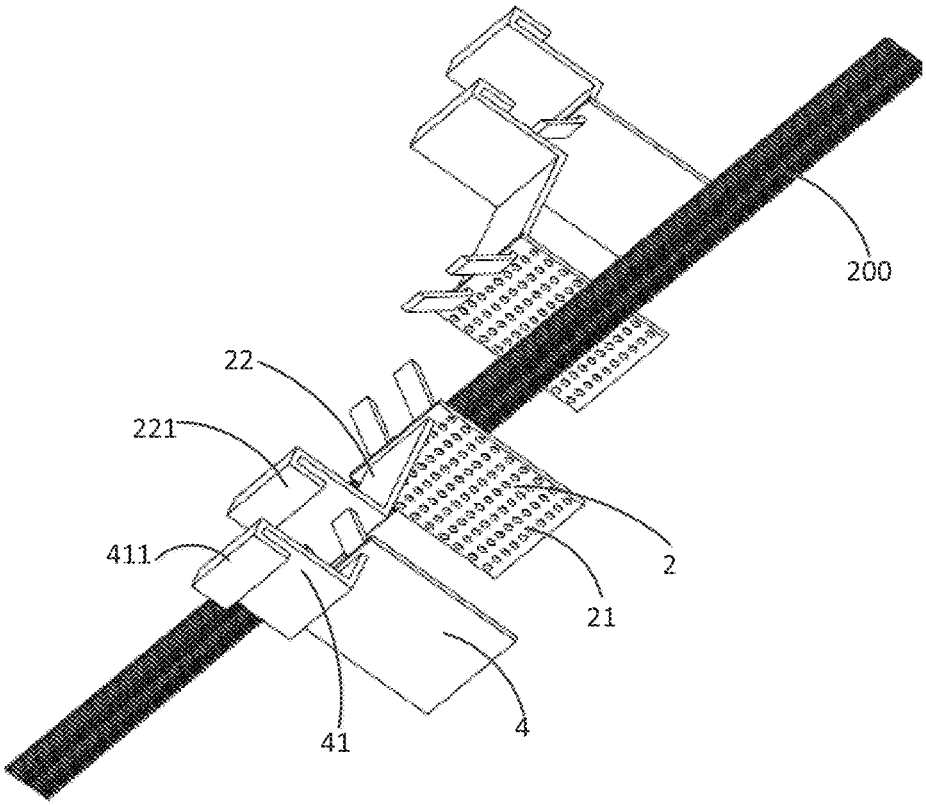
FIG. 9 shows an illustrative perspective view of an anode and a workpiece according to another exemplary embodiment of the present invention.

FIG. 5 shows an illustrative view of an electroplating system according to another exemplary embodiment of the present invention, in which the electroplating bath is cut way in a longitudinal direction. FIG. 6 shows another illustrative view of the electroplating system shown in FIG. 5, in which the electroplating bath is cut way in a transverse direction. FIG. 7 shows an illustrative view of an electroplating system according to another exemplary embodiment of the present invention, in which the electroplating bath is cut way in a transverse direction. FIG. 8 shows an illustrative perspective view of an electroplating device according to another exemplary embodiment of the present invention. FIG. 9 shows an illustrative perspective view of an anode and a workpiece according to another exemplary embodiment of the present invention.

As shown in FIGS. 5-9, the electroplating device 300 according to another embodiment of the invention also includes a second anode 4 on the basis of the electroplating device 100 shown in FIG. 1-3, and the electrolytic potential of the second anode 4 is lower than that of the first anode 2. The same or similar components of the electroplating device 300 shown in FIGS. 5-9 and the electroplating device 100 shown in FIGS. 1-3 use the same reference numerals.

In an embodiment, as shown in FIGS. 5-9, the electroplating device 300 includes an electroplating bath 1, a first anode 2, a second anode 4 and a liquid spraying device 3. The electroplating bath 1 is suitable for containing the electroplating solution into which the workpiece 200 to be electroplated as a cathode is at least partially immersed. The first anode 2 is provided in the electroplating bath 1. The liquid spraying device 3 comprises a main body part 31 and a plurality of nozzles 32. The main body part 31 is formed into a vacuum and is provided with at least one inlet for conveying the electroplating solution into the main body part 31. A plurality of nozzles 32 are installed on the main body part 31, and at least a part of the nozzles 32 are configured so that the flow direction of the electroplating solution ejected from the nozzle 32 is substantially parallel to the direction of the power line formed by the first anode 2 and the cathode. The electrolytic potential of the second anode 4 is lower than that of the first anode 2. In addition to realizing the technical effect of the electroplating device 100 described in FIGS. 1-3, the electroplating device 300 according to the embodiment of the present invention can perform alloy electroplating on the workpiece by using double anodes.

In an exemplary embodiment, as shown in FIGS. 5, 6, 8 and 9, the electroplating device 300 also includes two partition walls 9, which are suitable for separating the electroplating bath 1 into an outer containing part 13 and an inner containing part 14 located inside the outer containing part, a plurality of pairs of the first anodes 2 are arranged in the inner containing part, and a plurality of pairs of the second anodes 4 are arranged in the outer containing part 13. The partition wall 9 is formed with a plurality of second through holes 91 to allow the electroplating solution in the outer containing part 13 to flow into the inner containing part 14 through the second through holes 91.

In an exemplary embodiment, as shown in FIGS. 5, 7, 8 and 9, the second anodes 4 are placed in a basket 6 with a plurality of first through holes, and the electroplating solution can flow into or out of the basket 6 through the first through holes to cause an impact on the second anodes 4.

In an exemplary embodiment, as shown in FIG. 6, a pair of adjustment covers 7 are respectively provided on both sides of the second liquid inlet hole 12. The pair of adjustment covers 7 are suitable for adjusting the liquid level of the electroplating solution at the workpiece 200. Since the electroplating bath 1 is provided with nozzles 32, partition walls 9, liquid inlet holes and other mechanisms to promote or block the flow of electroplating solution, the liquid level of electroplating solution in the electroplating bath may be different in different parts. By setting the adjusting cover 7, the liquid level of electroplating solution at the workpiece 200 can be adjusted.

In an exemplary embodiment, as shown in FIGS. 4, 5, 6, 8 and 9, the first anode is mounted on the partition wall 9 by a first bracket 22, and the second anode is mounted on the side wall of the electroplating bath by a second bracket 41. Hooks 221 and 411 are respectively provided on the first bracket 22 and the second bracket 41.

In an exemplary embodiment, as shown in FIGS. 5-8, the electroplating device 300 also includes a power supply device 5 suitable for supplying power to the first anode 2 and the second anode 4. Further, the power supply device 5 includes a first current regulator 51 and a second current regulator 52 suitable for adjusting the current transmitted to the first anode 2 and the second anode 4, respectively.

In an exemplary embodiment, the first current regulator 51 and the second current regulator 52 are also adapted to adjust the proportion of current transmitted to the first anode 2 and the second anode 4 according to the proportion of metals in the alloy to be electroplated on the workpiece 200. In this way, the proportion of current transmitted to the first anode 2 and the second anode 4 can be adjusted, so that the proportion of metal ions in the electroplating solution is always balanced, and the alloy proportion of alloy electrodeposited coating can be accurately controlled.

In an exemplary embodiment, the alloy electrodeposited coating includes tin silver alloy, gold cobalt alloy, gold nickel alloy, palladium nickel alloy, tin nickel alloy, zinc nickel alloy, tin bismuth alloy, tin lead alloy, copper zinc tin alloy, zinc nickel iron alloy, etc. For example, the electrolytic potential of zinc (Zn (2+)) is −0.76V, the electrolytic potential of nickel (Ni (2+)) is −0.25V, the electrolytic potential of tin (Sn (2+)) is −0.14V, the electrolytic potential of lead (Pb (2+)) is −0.13V, the electrolytic potential of copper (Cu (2+)) is +0.34V, the electrolytic potential of silver (Ag (1+)) is +0.80V, and the electrolytic potential of gold (Au (1+)) is +1.68V.

In an exemplary embodiment, as shown in FIGS. 5-8, the electroplating device 300 also includes an auxiliary cathode 8, the power supply device also includes a third current regulator 53, the cathode of the third current regulator 53 is connected to the auxiliary cathode 8, and the anode of the third current regulator is connected to the second anode 4; The third current regulator 53 is suitable for supplying power to the second anode 4 during the second current regulator 52 stops transmitting current to the second anode 4, so that the second anode 4 has a positive potential to prevent the replacement reaction between the second anode 4 and the electroplating solution.

In an embodiment of the invention, the auxiliary cathode 8 is a weak electrolytic electrode, for example, made of inert conductors such as titanium, carbon and SUS316 stainless steel. The weak current flowing through the second anode 4 (low potential metal anode) is controlled to be about 0.01 A by the third current regulator 53, so that the second anode 4 is weakly positive without replacing the high potential metal in the electroplating solution. At the same time, when the auxiliary cathode is electroplated with as few alloy coating as possible (to reduce the loss), it will also absorb the foreign metal pollution in the electroplating solution, so as to purify the electroplating solution.

It can be understood that the first current regulator and the second current regulator can share one power supply or be connected to different power supplies respectively. The first, second and third current regulators may include rectifiers, such as silicon controlled rectifiers, respectively, or adjustable resistors.

FIGS. 10A-10D show illustrative perspective views of different installation modes of a pipe according to an exemplary embodiment of the present invention. In order to realize the flow of electroplating solution in multiple directions, a variety of liquid inlet holes can be provided to transport the electroplating solution from different parts to the electroplating bath. In an exemplary embodiment, as shown in FIGS. 6, 7 and 10A-10D, the bottom wall of the electroplating bath 1 is formed with first liquid inlet holes 15 roughly aligned with the second anode, which are suitable for conveying the electroplating solution towards the second anode 4 in a vertical direction. The bottom wall of the electroplating bath 1 is formed with second liquid inlet holes 12 roughly aligned with the workpiece 200, which are suitable for conveying the electroplating solution towards the workpiece 200 in a vertical direction.

Figure 10A:
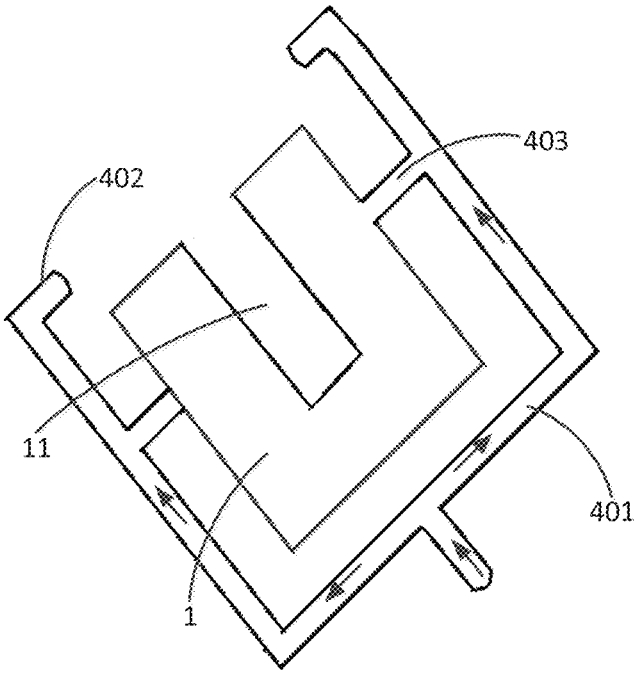
FIGS. 10A-10D show illustrative perspective views of different installation modes of a pipe according to an exemplary embodiment of the present invention.

In an exemplary embodiment, as shown in FIG. 10A and referring to FIGS. 2 and 7, the pipe 41 is provided with a first outlet 402 for communicating with the inlet 331 of the liquid spraying device 3 and a second outlet 403 for conveying the electroplating solution from the side wall of the electroplating bath 1 into the electroplating bath.

Figure 10B:
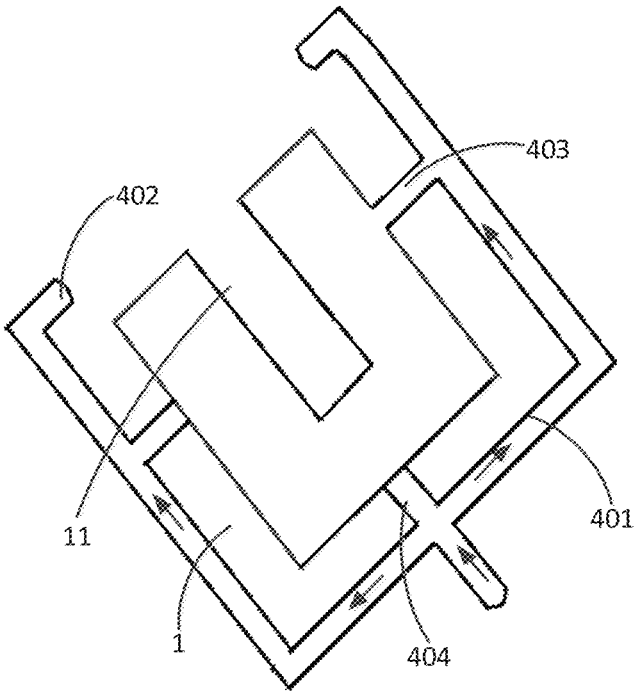

In an exemplary embodiment, as shown in FIG. 10B and referring to FIGS. 2 and 8, the pipe 41 is provided with a first outlet 402 for communicating with the inlet 331 of the liquid spraying device 3, a second outlet 403 for conveying the electroplating solution from the side wall of the electroplating bath 1 into the electroplating bath, and a third outlet 404 communicating with the second liquid inlet hole 12 on the bottom wall of the electroplating bath 1.

Figure 10C:
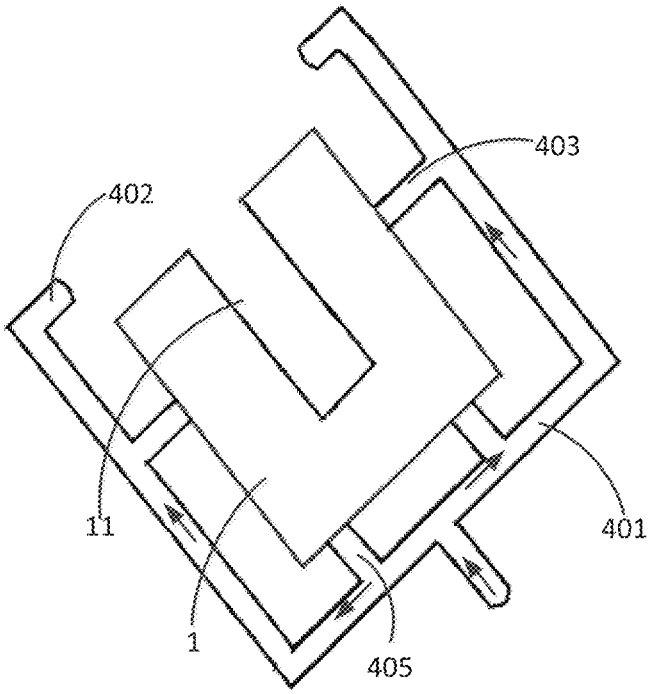

In an exemplary embodiment, as shown in FIG. 10C and referring to FIGS. 2 and 8, the pipe 41 is provided with a first outlet 402 for communicating with the inlet 331 of the liquid spraying device 3, a second outlet 403 for conveying the electroplating solution from the side wall of the electroplating bath 1 into the electroplating bath, and a fourth outlet 405 communicating with the first liquid inlet hole 15 on the bottom wall of the electroplating bath 1.

Figure 10D:
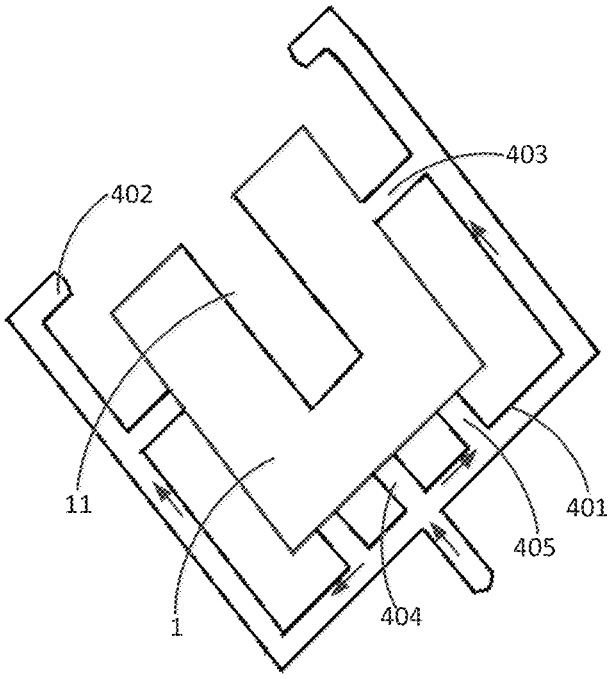

In an exemplary embodiment, as shown in FIG. 10D and referring to FIGS. 2 and 8, the pipe 41 is provided with a first outlet 402 for communicating with the inlet 331 of the spraying device 3, a second outlet 403 for conveying the electroplating solution from the side wall of the electroplating bath 1 into the electroplating bath, a third outlet 404 communicating with the second liquid inlet hole 12 on the bottom wall of the electroplating bath 1, and a fourth outlet 405 communicated with the first liquid inlet hole 15 on the bottom wall of the electroplating bath 1.

According to the embodiment of another aspect of the invention, as shown in FIGS. 5 and 6, the electroplating system includes the electroplating device 300, the tank 20 and the pump 40 according to any of the above embodiments, and the electroplating solution overflowing from the electroplating bath 1 flows into the tank 20; The pump 40 is suitable for pumping the electroplating solution from the tank 20 to the inlet 301 of the liquid spraying device 3 through the pipe 401, and the electroplating solution inside the liquid spraying device 3 is sprayed into the electroplating bath from each nozzle 32. The electroplating device 300 also includes a transition tank 30, and the electroplating solution overflowing from the electroplating bath 1 flows to the tank 20 through the transition tank 30.

In an exemplary embodiment, the electroplating system further includes a winding barrel 201 and an unwinding barrel 202, The material strip carrying the workpieces is wound onto the winding barrel 201, and the material strip is unwounded from the unwinding barrel 202. In this way, driven by the winding barrel, the electroplated workpieces arranged on the material strip can move longitudinally in the electroplating bath.

In addition, those areas in which it is believed that those of ordinary skill in the art are familiar, have not been described herein in order not to unnecessarily obscure the invention described. Accordingly, it has to be understood that the invention is not to be limited by the specific illustrative embodiments, but only by the scope of the appended claims.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of the elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. An electroplating device, comprising:

an electroplating bath adapted to contain an electroplating solution into which a workpiece defining a cathode to be electroplated is at least partially immersed;

a pair of first anodes arranged in the electroplating bath each first anode defining a plurality of through holes, one first anode of the pair of first anodes arranged on a side of the workpiece and the other of the first anode of the pair of first anodes arranged on the other side of the workpiece;

a second anode having an electrolytic potential that is lower than that of the pair of first anodes;

and a liquid spraying device, comprising:

a main body part having at least one inlet for conveying the electroplating solution into the main body part; and a plurality of nozzles installed on the main body party, wherein one first anode of the pair of first anodes is arranged between the liquid spraying device and the workpiece, at least part of the plurality of nozzles are positioned such that a flow direction of the electroplating solution ejected from the nozzle is substantially parallel to a direction of a power line formed by one first anode of the pair of first anodes and the cathode, a portion of the electroplating solution ejected from the plurality of nozzles in the flow direction flows through the plurality of through holes of one first anode of the pair of first anodes in the flow direction, one first anode of the pair of first anodes arranged between the workpiece and the second anode in the flow direction of the electroplating solution.

2. The electroplating device according to claim 1, wherein one first anode of the pair of first anodes comprises a plurality of first anodes and a gap is defined between two adjacent ones of the plurality of first anodes.

3. The electroplating device according to claim 1, wherein each of the plurality of nozzles is detachably mounted on the main body part, and the spraying direction of at least part of the plurality of nozzles is adjustable.

4. The electroplating device according to claim 1, wherein an output of the plurality of nozzles is sparse in a high current density region and dense in a low current density region.

5. The electroplating device according to claim 4, wherein an arrangement density of the plurality of nozzles on an upper part of the main body part is greater than that of the plurality of nozzles on a lower part of the main body part.

6. The electroplating device according to claim 1, wherein the main body part comprises:

a first part; and two second parts provided at both ends of the main body part, respectively, and extending towards the workpiece, and wherein the plurality of nozzles comprise:

a plurality of first nozzles mounted on the first part, the flow direction of the electroplating solution ejected from the plurality of first nozzles is substantially parallel to the direction of the power line formed by one first anode of the pair of first anodes and the cathode; and a plurality of second nozzles provided on the inner side of the two second parts and adapted to eject the electroplating solution toward the workpiece.

7. The electroplating device according to claim 1, wherein the workpiece is arranged on a material strip moving horizontally through the electroplating bath, the flow direction of the electroplating solution ejected from each of the plurality of first nozzles is perpendicular to the moving direction of the material strip, and each of two opposite side walls of the electroplating bath is provided with an overflow port, the material strip moves through the overflow port.

8. The electroplating device according to claim 1, wherein the second anode is arranged in a basket having a plurality of first through holes.

9. The electroplating device according to claim 1, further comprising two partition walls separating the electroplating bath into an outer containing part and an inner containing part located inside the outer containing part, wherein:

one first anode of the pair of first anodes is arranged in the inner containing part, and the second anode is arranged in the outer containing part;

a plurality of second through holes are formed in the partition walls allowing the electroplating solution in the outer containing part to flow into the inner containing part through the second through holes; and one first anode of the pair of first anodes, the second anode and the partition walls are arranged in parallel with one another.

10. The electroplating device according to claim 9, wherein one first anode of the pair of first anodes is installed on the partition wall by a first bracket, and the second anode is installed on the side wall of the electroplating bath by the second bracket.

11. The electroplating device according to claim 8, further comprising a power supply supplying power to the pair of first anodes and the second anode.

12. The electroplating device according to claim 11, wherein the power supply device comprises a first current regulator and a second current regulator adjusting the current delivered to the pair of first anodes and the second anode respectively.

13. The electroplating device according to claim 12, wherein the first current regulator and the second current regulator adjust the proportion of current transmitted to the pair of first anodes and the second anode according to the proportion of metals in an alloy to be electroplated on the workpiece.

14. The electroplating device according to claim 11, further comprising an auxiliary cathode, the power supply device further comprising a third current regulator, a cathode of the third current regulator is connected to the auxiliary cathode, and an anode of the third current regulator is connected to the second anode, the third current regulator supplying power to the second anode during the second current regulator stops transmitting current to the second anode.

15. The electroplating device according to claim 1, wherein a plurality of first liquid inlet holes substantially aligned with the second anode are arranged on the bottom wall of the electroplating bath, and the first liquid inlet holes are positioned to convey the electroplating solution towards the second anode in a vertical direction.

16. The electroplating device according to claim 1, wherein a plurality of second liquid inlet holes substantially aligned with the workpiece are arranged on the bottom wall of the electroplating bath, and the plurality of second liquid inlet holes are positioned to convey the electroplating solution towards the workpiece in a vertical direction.

17. The electroplating device according to claim 16, wherein a pair of adjustment covers are respectively provided on both sides of the plurality of second liquid inlet holes, and the adjustment covers are adapted to adjust a liquid level of the electroplating solution at the workpiece.

18. An electroplating system comprising:

an electroplating bath containing an electroplating solution into which a workpiece to be electroplated as a cathode is at least partially immersed;

a pair of first anodes arranged in the electroplating bath, each first anode defining a plurality of through holes, one first anode of the pair of first anodes arranged on a side of the workpiece and the other of the first anode of the pair of first anodes arranged on the other side of the workpiece;

a second anode having an electrolytic potential that is lower than that of the pair of first anodes;

a liquid spraying device, comprising:

a main body part, including:

a first part;

two second parts provided at both ends of the first part, respectively, and extending towards the workpiece; and at least one inlet for conveying the electroplating solution into the main body part;

a plurality of first nozzles mounted on the first part, a flow direction of the electroplating solution ejected from each of the plurality of first nozzles is substantially parallel to a direction of a power line formed by one first anode of the pair of first anodes and the cathode, one first anode of the pair of first anodes arranged between the plurality of first nozzles and the workpiece in the flow direction such that the electroplating solution flows through one first anode of the pair of first anodes; and a plurality of second nozzles provided on an inner side of each of the two second parts and adapted to eject the electroplating solution toward the workpiece, the plurality of second nozzles arranged on a first one of the two second parts opposing the plurality of second nozzles arranged on a second one of the two second parts;

wherein one first anode of the pair of first anodes is arranged between the liquid spraying device and the workpiece, one first anode of the pair of first anodes arranged between the workpiece and the second anode in the flow direction of the electroplating solution;

a tank into which the electroplating solution overflowing from the electroplating bath flows; and a pump adapted to pump the electroplating solution from the tank to the inlet of the liquid spraying device through a pipe.

19. An electroplating device, comprising:

an electroplating bath adapted to contain an electroplating solution into which a workpiece defining a cathode to be electroplated is at least partially immersed;

a pair of first anodes arranged in the electroplating bath, each first anode defining a plurality of first through holes, one first anode of the pair of first anodes arranged on a side of the workpiece and the other of the first anode of the pair of first anodes arranged on the other side of the workpiece;

a pair of second anodes each having an electrolytic potential that is lower than that of the first anodes; and a liquid spraying device, comprising:

a main body part having at least one inlet for conveying the electroplating solution into the main body part;

a plurality of nozzles installed on the main body part on each side of the workpiece, wherein at least part of the plurality of nozzles are positioned such that a flow direction of the electroplating solution ejected from the plurality of nozzles is substantially parallel to a direction of a power line formed by each of the first anodes and the cathode with at least a portion of the electroplating solution ejected from the plurality of nozzles in the flow direction flows through the plurality of first through holes of the first anodes in the flow direction, the first anode arranged between respective ones of the plurality of nozzles and the workpiece in the flow direction, on each side of the workpiece one first anode of the pair of first anodes is arranged between the workpiece and one second anode of the pair of second anodes in the flow direction of the electroplating solution; and two partition walls separating the electroplating bath into two outer containing parts arranged on each side of an inner containing part located between the two outer containing parts, wherein:

each of the first anodes is arranged in the inner containing part, and each of the second anodes is arranged in a respective one of the outer containing parts;

a plurality of second through holes are formed in the partition walls allowing the electroplating solution in the outer containing parts to flow into the inner containing part through the second through holes; and one first anode of the pair of first anodes, one second anode of the pair of second anodes and the partition walls are arranged in parallel with one another.

20. The electroplating device according to claim 19, wherein the main body part comprises:

a first part; and two second parts provided at both ends of the main body part, respectively, and extending towards the workpiece, and wherein the plurality of nozzles comprise:

a plurality of first nozzles mounted on the first part, the flow direction of the electroplating solution ejected from the plurality of first nozzles is substantially parallel to the direction of the power line formed by one first anode of the pair of first anodes and the cathode; and a plurality of second nozzles provided on the inner side of each of the two second parts and adapted to eject the electroplating solution toward the workpiece, the plurality of second nozzles arranged on a first one of the two second parts opposing the plurality of second nozzles arranged on a second one of the two second parts.

* * * * *